US009739209B2

(12) United States Patent
Riepl et al.

(10) Patent No.: US 9,739,209 B2
(45) Date of Patent: Aug. 22, 2017

(54) METHOD FOR OPERATING A FUEL INJECTION SYSTEM OF AN INTERNAL COMBUSTION ENGINE

(71) Applicant: Continental Automotive GmbH, Hannover (DE)

(72) Inventors: Hans Riepl, Hemau (DE); Tobias Ritsch, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 19 days.

(21) Appl. No.: 14/905,885

(22) PCT Filed: Jun. 16, 2014

(86) PCT No.: PCT/EP2014/062586
§ 371 (c)(1),
(2) Date: Jan. 18, 2016

(87) PCT Pub. No.: WO2015/007446
PCT Pub. Date: Jan. 22, 2015

(65) Prior Publication Data

US 2016/0177842 A1 Jun. 23, 2016

(30) Foreign Application Priority Data

Jul. 18, 2013 (DE) ..... 10 2013 214 083

(51) Int. Cl.
*F02D 41/30* (2006.01)
*F02D 1/06* (2006.01)
(Continued)

(52) U.S. Cl.
CPC ..... *F02D 1/06* (2013.01); *F02D 41/3845* (2013.01); *F02M 39/005* (2013.01); *F02D 41/20* (2013.01); *F02D 2200/0602* (2013.01)

(58) Field of Classification Search
CPC ..... F02D 1/06; F02D 41/3845; F02D 41/20; F02D 2200/0602; F02D 2250/31;
(Continued)

(56) References Cited

U.S. PATENT DOCUMENTS 5,937,826 A 8/1999 Olson et al. ..... 123/447
6,976,473 B2 12/2005 Boos et al. ..... 123/446
(Continued)

FOREIGN PATENT DOCUMENTS

DE 102005013917 A1 10/2005 ..... F02D 1/02
DE 102004023962 A1 12/2005 ..... F02D 1/02
(Continued)

OTHER PUBLICATIONS

German Office Action, Application No. 102013214083.5, 4 pages, Mar. 3, 2014.
(Continued)

*Primary Examiner* — Hai Huynh
(74) *Attorney, Agent, or Firm* — Slayden Grubert Beard PLLC

(57) ABSTRACT

A method for operating a fuel injection system of an internal combustion engine is disclosed. The fuel injection system comprises a high pressure accumulator (rail) and a high-pressure fuel pump with a digital inlet valve and which guides fuel into the high pressure accumulator. The number of the control pulses for the digital inlet valve and thus the number of the pump delivery strokes is reduced with respect to the number of the injection steps of an injector of the injection system, in order to thereby reduce the noise and the energy consumption of the high-pressure pump.

18 Claims, 1 Drawing Sheet

(51) Int. Cl.

| | |
|---|---|
| ***F02D 41/38*** | (2006.01) |
| ***F02M 39/00*** | (2006.01) |
| *F02D 41/20* | (2006.01) |

(58) Field of Classification Search

CPC .. F02M 39/005; F02M 59/366; F02M 59/466; F02M 59/468

USPC ..... 123/446, 447, 457, 458, 497, 498, 499, 123/510, 511

See application file for complete search history.

(56) References Cited

U.S. PATENT DOCUMENTS

| | | | | |
|---|---|---|---|---|
| 7,010,415 | B2 * | 3/2006 | Dolker | F02D 41/222 123/456 |
| 7,198,033 | B2 | 4/2007 | Inaguma et al. | 123/506 |
| 7,373,924 | B1 | 5/2008 | Krengel et al. | 123/457 |
| 7,975,674 | B2 * | 7/2011 | Kylstrom | F02M 59/08 123/495 |
| 9,279,404 | B2 * | 3/2016 | Aoki | F02D 41/222 |
| 2016/0169144 | A1 * | 6/2016 | Surnilla | F02D 41/3845 123/435 |

FOREIGN PATENT DOCUMENTS

| | | | | |
|---|---|---|---|---|
| DE | 102012200764 | B3 | 7/2013 | F02M 37/00 |
| EP | 1327766 | A2 | 7/2003 | F02D 41/00 |
| EP | 1357285 | A2 | 10/2003 | F02D 41/38 |
| EP | 2241744 | A1 | 10/2010 | F02M 59/02 |
| EP | 2287457 | A1 | 2/2011 | F02D 41/08 |
| WO | 2015/007446 | A1 | 1/2015 | F02D 41/38 |

OTHER PUBLICATIONS

International Search Report and Written Opinion, Application No. PCT/EP2014/062586, 19 pages, Sep. 24, 2014.

Korean Office Action, Application No. 2017029600618, 7 pages, dated Apr. 25, 2017.

* cited by examiner

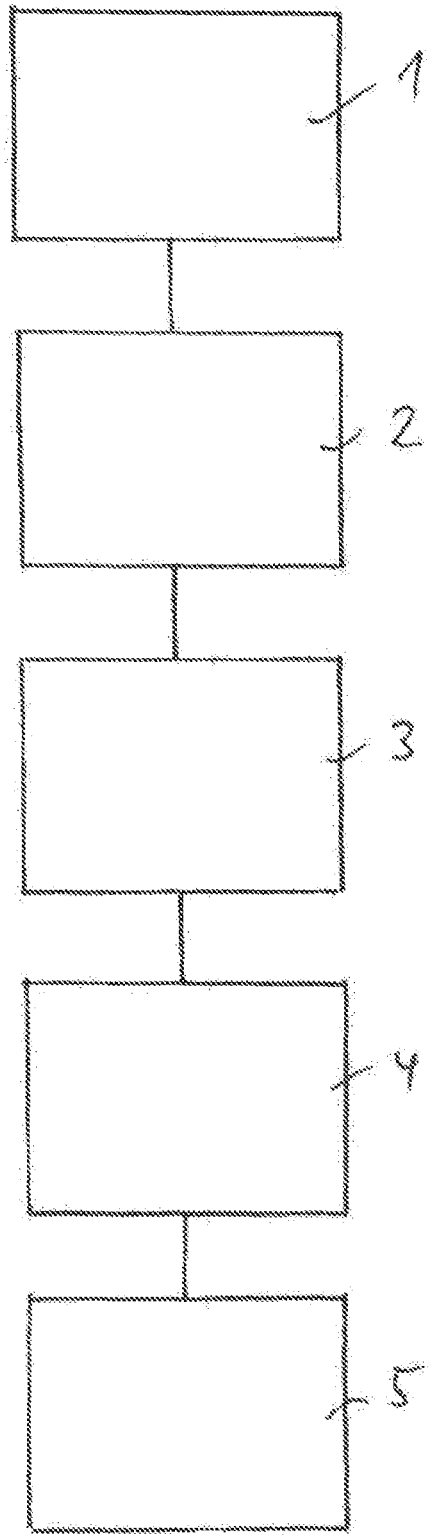
1
2
3
4
5

METHOD FOR OPERATING A FUEL INJECTION SYSTEM OF AN INTERNAL COMBUSTION ENGINE

CROSS-REFERENCE TO RELATED APPLICATIONS

This application is a U.S. National Stage Application of International Application No. PCT/EP2014/062586 filed Jun. 16, 2014, which designates the United States of America, and claims priority to DE Application No. 10 2013 214 083.5 filed Jul. 18, 2013, the contents of which are hereby incorporated by reference in their entirety.

TECHNICAL FIELD

The present invention relates to a method for operating a fuel injection system of an internal combustion engine, which fuel injection system has a high pressure rail and a high pressure fuel pump which feeds fuel into the high pressure rail and has a digital inlet valve.

BACKGROUND

Fuel injection systems of this type are used in modern petrol or diesel engines. In addition to the injectors, the high pressure rail, said injectors also have a high pressure fuel pump for generating the necessary pressure. In this context, fuel is fed from a fuel tank by a pre-feed pump to the high pressure pump which feeds the fuel under high pressure to the high pressure rail. The injectors are fed via the high pressure rail.

In modern injection systems, high pressure fuel pumps with digital inlet valves are used. The term digital inlet valve here denotes a valve which assumes only an open position or closed position and is not actuated to assume intermediate positions. Such digital inlet valves are activated electromagnetically. In the inlet phase, the inlet valve is opened, with the result that the piston of the high pressure pump can suck fuel into the cylinder. In the feed phase, the inlet valve is closed and the piston of the high pressure pump forces fuel into the high pressure system.

In other embodiments (valves which are closed in the currentless state (D/V), the inlet valve is kept open electrically during the induction and is deactivated in the expulsion phase if feed is desired.

Electrical energy is required to activate such a digital inlet valve. Furthermore, switching noise is generated owing to the opening/closing of the digital inlet valve. Such noise emissions are undesired. There is also generally an interest in lowering the energy consumption of such injection systems.

Certain methods are known for reducing the noise emissions owing to the actuation and therefore the closing and/opening of a digital inlet valve. An example of this is to use a specific current profile to actuate the digital inlet valve. This method is relatively costly.

SUMMARY

One embodiment provides a method for operating a fuel injection system of an internal combustion engine, which fuel injection system has a high pressure rail and a high pressure fuel pump which feeds fuel into the high pressure rail and has a digital inlet valve, wherein the number of actuation pulses for the digital inlet valve and therefore the number of pump feed strokes is reduced compared to the number of injection processes of an injector of the injection system.

In a further embodiment, the number of actuation pulses is reduced taking into account a rail pressure limiting value or rail pressure range which is to be complied with as a function of emission limiting values of the internal combustion engine.

In a further embodiment, the number of actuation pulses is reduced as a function of the operating state of the internal combustion engine and therefore of the requested injection quantity and/or possible present leakage.

In a further embodiment, the high pressure pump is actuated in such a way that after the reduction of the number of actuation pulses a quantity of fuel is fed which is larger in comparison, in order to compensate for the pressure loss.

In a further embodiment, the rail pressure limiting value or rail pressure range which is to be complied with is determined by trials for the internal combustion engine, or each internal combustion engine, in the development phase thereof.

In a further embodiment, the method is carried out only in specific parts of the engine characteristic diagram such as during idling or under partial load.

In a further embodiment, a corresponding engine characteristic diagram is implemented in the engine control device in order to switch the rail pressure control strategy from injection-synchronous to non-injection-synchronous.

In a further embodiment, a pressure drop which is brought about by the injection is calculated in advance, and as a result a rail pressure limiting value or rail pressure range which is to be complied with and above which or within which the feeding by the pump is deactivated temporarily by reducing the actuation pulses is defined.

In a further embodiment, the high pressure fuel pump has a digital outlet valve in addition to the digital inlet valve, wherein the digital outlet valve is actuated in a way which is analogous to the digital inlet valve.

BRIEF DESCRIPTION OF THE DRAWING

An example embodiment of the disclosed method is described below with reference to FIG. 1, which shows a schematic block diagram of the individual method steps.

DETAILED DESCRIPTION

Embodiments of the invention provide a method for operating a fuel injection system of the type described at the beginning, which method permits particularly low-noise operation of the high pressure fuel pump with simple means.

In the fuel injection systems described above, the high pressure fuel pump usually feeds synchronously with the injection, i.e. a pump feed stroke, which compensates the quantity lost by the injection and possibly present leakages, occurs at each injection or proceeds simultaneously.

The presently disclosed method departs from this. According to the disclosed method, a non-injection-synchronous pump feed is carried out in a targeted fashion. In other words, the number of actuation pulses for the digital inlet valve at the high pressure pump is reduced compared to the number of injection processes, which gives rise to a reduction in the noise emission by the digital inlet valve and leads to a reduction in the energy required by the actuation. As a result of the reduction of the switching frequency, the number of load cycles (number of valve movements plotted over the service life) is decreased, which also has a positive effect on the durability of the high pressure pump or of the inlet valve. It was determined by trials that a reduction in noise of approximately 4 dB (A) is already achieved by dispensing with a switching process compared to the known injection-synchronous activation of the inlet valve.

The number of actuation pulses is preferably reduced taking into account a rail pressure limiting value or rail pressure range which is to be complied with as a function of emission limiting values of the internal combustion engine.

In this variant of the method according to the invention, it is taken into account that the number of actuation pulses for the digital inlet valve and therefore the number of pump feed strokes is reduced compared to the number of injection processes only to such an extent that as a result a rail pressure limiting value or rail pressure range which results from emission limiting values of the internal combustion engine is complied with. Such emission limiting values, for example those from exhaust gas legislation (EU4, EU5, EU6 etc.), and the resulting rail pressure limiting values or rail pressure ranges are known or can be calculated or determined by trials. For example, combustion testing with diesel common rail injection systems shows that a motor-dependent deviation of up to 16% from the pressure setpoint for reaching the current emission limit (EU6) can be permissible. If such a rail pressure limiting value or rail pressure range has been determined, according to the invention it is possible to proceed in such a way that the number of saved actuation pulses is increased successively during the operation of the internal combustion engine until the corresponding rail pressure limiting value or the lower limit of the rail pressure range is reached, after which the inlet valve is actuated again in order to start the feeding again.

In this context, the number of actuation pulses is preferably reduced as a function of the operating state of the internal combustion engine and therefore of the requested injection quantity and/or possibly present leakage. For example, the number of actuation pulses is reduced during idling or under partial load.

The high pressure pump is actuated in such a way that after the reduction of the number of actuation pulses a quantity of fuel is fed which is larger in comparison, in order to compensate for the pressure loss.

In one specific embodiment of the method according to the invention, the rail pressure limiting value or rail pressure range which is to be complied with is determined by trials for each internal combustion engine in the development phase thereof. During subsequent operation of the internal combustion engine, the digital inlet valve of the high pressure pump is then actuated in such a way that at least one switching process of the inlet valve is saved, without the rail pressure limiting value which is determined by trials or the corresponding rail pressure range being undershot or exited.

As already mentioned, the method according to the invention is preferably carried out only in specific parts of the engine characteristic diagram such as during idling or under partial load.

In order to provide a switching facility with which it is possible to switch from injection-synchronous actuation of the inlet valve to non-injection-synchronous actuation, a corresponding engine characteristic diagram is expediently implemented in the engine control device. In this way, the rail pressure control strategy according to the invention can be carried out.

In another variant of the method according to the invention, a pressure drop which is brought about by the injection is calculated in advance, and as a result a rail pressure limiting value or rail pressure range which is to be complied with and above which or within which the feeding by the pump is deactivated temporarily by reducing the actuation pulses is defined. In this context, the pressure reduction as a result of the injection can be calculated in advance by means of the injection quantity calculated by the engine control device, using the physical relationship Pressure drop=compression modulus of the fuel× change in volume at high pressure/total high pressure volume.

the corresponding engine-specific data such as high pressure volume and fuel-specific data are stored in the engine control device here.

Through the corresponding deactivation of the digital inlet valve, the noise emissions are reduced in correspondingly relevant operating states, in particular during idling. In addition, this contributes to reducing the energy requirement. The number of valve switching operations over the service life also decreases.

The method according to the invention can also be applied in an injection system in which the high pressure fuel pump has a digital outlet valve in addition to the digital inlet valve. In this context, the digital outlet valve is actuated in a way which is analogous to the digital inlet valve.

A combination of the method according to the invention with existing noise reducing measures, for example the whispering function, for actuating the digital inlet valve of the high pressure pump is possible.

In step 1 of the method according to the invention, a limiting value for the rail pressure as far as which the rail pressure can drop is determined by trials, without corresponding emission limiting values from the exhaust gas legislation, for example EU6, being exceeded as a result. The corresponding limiting value or limiting range for the rail pressure is stored in the engine control device. In addition, in step 2 a corresponding characteristic diagram is implemented as a function of, for example, the engine speed and the injection quantity etc., in order to permit switching to the rail pressure control strategy according to the invention.

During the operation of the fuel injection system or of the corresponding vehicle, in step 3 of the method according to the invention switching over is performed to the rail pressure control strategy according to the invention if the engine is, for example, in the idling mode.

In this context, the feeding of fuel by the high pressure pump, i.e. the actuation of the digital inlet valve of the high pressure pump, is not implemented until the stored rail pressure limiting value is reached. This may involve, for example, one, two or more feed strokes, with the result that one, two or more switching processes for the inlet valve are dispensed with. The implementation of the rail pressure strategy according to the invention by deactivating the inlet valve until the rail pressure limiting value is reached takes place in step 4.

If the stored limiting value for the rail pressure is reached, the digital inlet valve of the high pressure pump is activated again, and a quantity of fuel which is larger in comparison is fed into the rail in order to compensate more quickly for the pressure loss which has occurred. This is illustrated in step 5.

What is claimed is:

1. A method for operating a fuel injection system of an internal combustion engine, which fuel injection system has at least one fuel injector coupled to a high pressure rail and a high pressure fuel pump which feeds fuel into the high pressure rail and has a digital inlet valve, the method comprising:

operating the fuel injection system according to a first control protocol, comprising:

controlling the at least one fuel injector to perform a first plurality of injection processes, and activating the digital inlet valve of the high pressure fuel pump using a number of first actuation pulses corresponding to the number of the first plurality of injection processes, wherein each first actuation pulse opens the digital inlet valve to permit a pump feed by the high pressure fuel pump, automatically switching over to a rail pressure control protocol for the fuel injection system in response to a predefined engine operation event, and operating the fuel injection system according to the rail pressure control protocol, comprising:

controlling the at least one fuel injector to perform a second series of injection processes, and activating the digital inlet valve of the high pressure fuel pump using a number of second actuation pulses that is less than the number of the second plurality of injection processes, wherein each second actuation pulse opens the digital inlet valve to permit a pump feed by the high pressure fuel pump.

2. The method of claim 1, wherein the number of second actuation pulses is reduced as a function of a predefined minimum rail pressure limiting value or rail pressure range corresponding to emission limiting values of the internal combustion engine.

3. The method of claim 2, wherein the predefined minimum rail pressure limiting value or rail pressure range is determined by trials in an engine development phase.

4. The method of claim 1, wherein the number of second actuation pulses is reduced as a function of an operating state of the internal combustion engine.

5. The method of claim 1, wherein according to the rail pressure control protocol, the high pressure pump is actuated such that after one or more injection processes without a corresponding activation of the digital inlet valve, a subsequent actuation pulse is generated that causes a pump feed having an increased quantity of fuel to compensate for a pressure loss resulting from the one or more injection processes without a corresponding activation of the digital inlet valve.

6. The method of claim 1, wherein the method is performed only during operation of the engine in specific areas of an engine characteristic diagram.

7. The method of claim 6, wherein a corresponding engine characteristic diagram is implemented in an engine control device in order to switch the rail pressure control protocol from the first control protocol to the rail pressure control protocol.

8. The method of claim 1, further comprising:

calculating a pressure drop associated with a representative injection process, and reducing the number of second actuation pulses as a function of (a) the predefined rail pressure limiting value or rail pressure range and (b) the calculated pressure drop.

9. The method of claim 1, wherein:

the high pressure fuel pump has a digital outlet valve in addition to the digital inlet valve, and the method comprises activating—the digital outlet valve in a manner analogous to the activation of the digital inlet valve.

10. A fuel injection system of an internal combustion engine, the fuel injection system comprising:

at least one fuel injector coupled to a high pressure rail, a high pressure fuel pump which feeds fuel into the high pressure rail and has a digital inlet valve, and a control device configured to:

operate the fuel injection system according to a first control protocol, comprising:

controlling the at least one fuel injector to perform a first plurality of injection processes, and activating the digital inlet valve of the high pressure fuel pump using a number of first actuation pulses corresponding to the number of the first plurality of injection processes, wherein each first actuation pulse opens the digital inlet valve to permit a pump feed by the high pressure fuel pump, automatically switch over to a rail pressure control protocol for the fuel injection system in response to a predefined engine operation event, and operate the fuel injection system according to the rail pressure control protocol, comprising:

controlling the at least one fuel injector to perform a second series of injection processes, and activating the digital inlet valve of the high pressure fuel pump using a number of second actuation pulses that is less than the number of the second plurality of injection processes, wherein each second actuation pulse opens the digital inlet valve to permit a pump feed by the high pressure fuel pump.

11. The fuel injection system of claim 10, wherein the number of second actuation pulses is reduced as a function of a predefined minimum rail pressure limiting value or rail pressure range corresponding to emission limiting values of the internal combustion engine.

12. The fuel injection system of claim 11, wherein the predefined minimum rail pressure limiting value or rail pressure range is determined by trials in an engine development phase.

13. The fuel injection system of claim 10, wherein the number of second actuation pulses is reduced as a function of an operating state of the internal combustion engine.

14. The fuel injection system of claim 10, wherein according to the rail pressure control protocol, the control device is configured activate the high pressure pump such that after one or more injection processes without a corresponding activation of the digital inlet valve, a subsequent actuation pulse is generated that causes a pump feed having an increased quantity of fuel to compensate for a pressure loss resulting from the one or more injection processes without a corresponding activation of the digital inlet valve.

15. The fuel injection system of claim 10, wherein the control device is configured to switch to the rail pressure control protocol only during operation of the engine in specific areas of an engine characteristic diagram.

16. The fuel injection system of claim 15, wherein the control device implements a corresponding engine characteristic diagram in order to switch the rail pressure control protocol from the first control protocol to the rail pressure control protocol.

17. The fuel injection system of claim 10, wherein the control device is further configured to:

calculate a pressure drop associated with a representative injection process, and reduce the number of second actuation pulses as a function of (a) the predefined rail pressure limiting value or rail pressure range and (b) the calculated pressure drop.

18. The fuel injection system of claim 10, wherein:

the high pressure fuel pump has a digital outlet valve in addition to the digital inlet valve, and the control device is further configured to activate the digital outlet valve in a manner analogous to the activation of the digital inlet valve.

* * * * *